US006007763A

United States Patent [19]

Bucker et al.

[11] Patent Number: 6,007,763

[45] Date of Patent: Dec. 28, 1999

[54] PROCESS AND INSTALLATION FOR PREPARING A HEAT TREATMENT ATMOSPHERE

[75] Inventors: Klaus Bucker, Dusseldorf, Germany; Pascale Pourtalet McSweeney, Les Loges en Josas; Philippe Poynot, Gif sur Yvette, both of France

[73] Assignee: L'Air Liquide, Societe Anonyme Pour L'Etude et L'Exploitation des Procedes Georges Claude, Paris, France

[21] Appl. No.: 09/177,532

[22] Filed: Oct. 23, 1998

Related U.S. Application Data

[63] Continuation of application No. 08/658,833, May 31, 1996.

[30] Foreign Application Priority Data

Apr. 23, 1996 [FR] France ..... 9605106

[51] Int. Cl.[6] ..... C21D 1/06

[52] U.S. Cl. ..... 266/257; 148/206

[58] Field of Search ..... 266/252, 257; 148/206, 231

[56] References Cited

U.S. PATENT DOCUMENTS 5,242,509 9/1993 Rancon et al. .
5,348,592 9/1994 Garg et al. .
5,441,581 8/1995 Van Den Sype et al. .

FOREIGN PATENT DOCUMENTS 482992 4/1992 European Pat. Off. .
598384 5/1994 European Pat. Off. .
692545 1/1996 European Pat. Off. .
2286789 4/1976 France .
2822048 11/1979 Germany .
93/21350 10/1993 WIPO .

OTHER PUBLICATIONS

Patent Abstracts of Japan, No. JP62004439 published Oct. 1, 1987, M. Hiroshi et al., "Apparatus for Producing Atmospheric Gas".

*Primary Examiner*—Scott Kastler
*Attorney, Agent, or Firm*—Burns, Doane, Swecker & Mathis, LLP

[57] ABSTRACT

The invention relates to a process for preparing a heat treatment atmosphere by a catalytic reaction in a catalytic reactor (16) between a first gas mixture (12) containing oxygen and a second gas mixture (26) containing a hydrocarbon, characterized in that the catalytic reactor is arranged in substantially vertical position and in that the reaction mixtures are introduced into the catalytic reactor through the bottom (19) of the reactor with recovery of the heat treatment atmosphere resulting from the reaction at the top (20) of the reactor.

15 Claims, 5 Drawing Sheets

PROCESS AND INSTALLATION FOR PREPARING A HEAT TREATMENT ATMOSPHERE

This application is a continuation, of application Ser. No. 08/658,833, filed May 31, 1996.

BACKGROUND OF THE INVENTION (i) Field of the Invention

The present invention relates to the field of the atmospheres used in heat treatment furnaces. More particularly, it is concerned with atmospheres as afforded by the deoxygenation of an oxygen-containing gas mixture (such as, for example, consisting of air, or a mixture of air and cryogenically obtained nitrogen, or an impure nitrogen produced by the separation of air by permeation or adsorption) by the reaction of this mixture with hydrocarbon in a catalytic deoxygenation reactor.

These atmospheres usually contain a majority species which is generally nitrogen, which may be supplemented, depending on the type of heat treatment performed and the nature of the treated materials, with additional more or less active species such as $H_2$, CO, $H_2O$, $CO_2$, or hydrocarbons.

(ii) Description of Related Art

In EP-A 482,992 the applicant proposed a catalytic method for preparing such heat treatment atmospheres in which the reaction of impure nitrogen+hydrocarbon is carried out over a precious metal-based catalyst at a temperature between 400° C. and 900° C.

Studies pursued by the applicant on this subject showed that the performance of this process required improvement, particularly in the following areas:

- improvement in the composition of the prepared atmosphere in order to decrease when necessary the concentration of oxidizing species and decarburizing species such as $CO_2$ and $H_2O$; and
- improvement in the operating conditions for the catalyst for the purpose of extending its life.

SUMMARY AND OBJECTS OF THE INVENTION

Based on these studies the applicant has been able to show that it is possible to arrive at a technical solution for these two objectives by employing a catalytic reactor with a particular configuration. This particular configuration, which will be described in greater detail below, permits:

- better control of the reactions taking place within the catalytic reactor;
- a more favorable temperature distribution within the catalyst, which functions to prolong its life and improve its performance.

In this configuration, the catalytic reactor is positioned substantially vertically, the introduced gas mixtures (containing oxygen and hydrocarbon) enter the reactor at its bottom, and the heat treatment atmosphere resulting from the reaction between the two species is recovered and discharged from the top of the reactor.

The technical points developed below make it possible to attempt to offer an explanation of the improved results obtained with this particular configuration, but this explanation should be construed as nonrestrictive considering the complexity of the system.

One must first recall that the reaction process taking place within the catalytic reactor between oxygen and hydrocarbon in fact consists of several elementary reactions.

Part of the hydrocarbon reacts first with oxygen to produce essentially carbon dioxide and water. Any oxygen in the atmosphere is thus consumed. It should be noted that the reactions which take place during the first reaction stage are exothermic reactions.

For illustration, the following two reactions occur during this first reaction stage for the case of natural gas composed primarily of methane:

$$CH_4+O_2 \rightarrow CO_2+2H_2$$

$$CH_4+2O_2 \rightarrow 2H_2O+CO_2$$

The reaction gases entering the reactor must be heated to some degree to initiate the preceding exothermic reactions.

During a second period (second reaction stage), the residual hydrocarbon in the atmosphere reacts with the carbon dioxide and water formed during the above-mentioned reactions. The reactions taking place in the course of this second reaction stage are strongly endothermic. To permit a favorable development of these endothermic reactions, the catalytic reactor is ordinarily heated to a temperature which can be as high as several hundred ° C. or even above 1000° C. depending on the type of catalyst used.

Still for illustration, in the case of natural gas the following two reactions are encountered in particular during the second reaction stage:

$$CH_4+H_2O \rightarrow CO+3H_2$$

$$CH_4+CO_2 \rightarrow 2CO+2H_2$$

The case will now be considered of a vertically positioned catalytic reactor supplied with reactants through the top of the catalytic reactor. In such a case, the exothermic reactions described above take place immediately in the upper part of the reactor, while the endothermic reactions take place in the lower part of the reactor.

Such a configuration thus has two major drawbacks:

i) The heat introduced by the reactor's electric heating resistances naturally has a tendency to rise from the bottom of the reactor toward the top of the reactor (natural convection).

The upper part of the reactor is thus the most strongly heated section. However, this heat from the electric heating is combined with the heat released by the exothermic reactions occurring precisely in the upper part of the reactor.

The upper part of the reactor is thus subjected to particularly high temperatures, which can lead to sintering of the catalyst pellets and thus a deterioration that can produce a reduction in the activity of the catalyst;

ii) Moreover, this heat, which thus accumulates in the top part of the reactor, in fact accumulates in the zone where the exothermic reactions that consume little energy occur, which as a consequence does not favor the endothermic reactions which as previously noted are essentially localized in the lower part of the reactor.

Thus, this configuration "favors" the reactions that produce $CO_2$ and $H_2O$ instead of favoring the reactions that produce CO and $H_2$, which are the two fundamental species sought for heat treatment.

The configuration of the catalytic reactor according to the invention serves to mitigate these two drawbacks. In effect, in the invention configuration the reaction gases (mixture containing oxygen and mixture containing hydrocarbon) are injected into the bottom of the catalytic reactor, while the prepared heat treatment atmosphere is recovered at the top of the reactor, with the reactor being placed in a substantially vertical position. The exothermic reactions take place essentially at the bottom of the reactor while the endothermic reactions take place essentially at the top of the reactor: the heat accumulated at the top of the reactor as a result of natural convection can thus directly favor these endothermic reactions.

One therefore simultaneously obtains the advantages of favoring the endothermic reactions for production of hydrogen and CO while also avoiding overheating of the catalyst in this region since the heat which rises into the upper part of the reactor is at least partially consumed by the endothermic reactions.

As explained in greater detail below in the context of examples, such a configuration:

- results in a more homogeneous temperature profile within the catalyst, thus limiting the formation of hot spots;
- results in a lowering of the amounts of carbon dioxide and water vapor in the prepared atmosphere; and
- all other operating conditions being held the same, results in the possibility as desired of lowering the setpoint for the catalyst heating temperature by tens of degrees, which unquestionably represents an economic advantage.

The process according to the invention for preparing a heat treatment atmosphere in a catalytic reactor by a catalytic reaction between a first gas mixture containing oxygen and a second gas mixture containing hydrocarbon is thus characterized in that the catalytic reactor is in a substantially vertical position and in that the gas mixtures are introduced into the catalytic reactor through the bottom of the reactor with recovery of the heat treatment atmosphere resulting from the reaction through the top of the catalytic reactor.

Throughout the following text, the abbreviated qualifier "vertical" will be employed to refer to the positioning of the catalytic reactor in the installation, while operating within the context that the scope of the invention includes the use of a very slightly inclined reactor (in practice, a few degrees), wherein the essential point is to be able to define a low point for the entry of the reaction gases and a high point for exit of the prepared heat treatment atmosphere.

According to one embodiment of the invention, the catalytic reactor contains a catalyst based on a precious metal such as platinum or palladium, and the reaction is carried out at a temperature between 400° C. and 900° C.

According to another embodiment of the invention, the catalytic reactor contains a catalyst based on a nonnoble metal such as nickel, and the reaction is carried out at a temperature between 800° C. and 1200° C.

The oxygen-containing first mixture can, for example, consist of an impure nitrogen produced on site by separation of air using a membrane process or adsorption process; the residual oxygen content of such a first gas mixture is then advantageously between 0.5 and 7 volume % and preferably between 2 and 7 volume %.

Again for purposes of illustration, the oxygen-containing first gas mixture can also consist of a mixture of air and cryogenically obtained nitrogen.

The hydrocarbon-containing second gas mixture can, for example, consist of natural gas, or propane, or a mixture of hydrocarbons.

According to one embodiment of the invention, the second gas mixture is a recovery by-product from an industrial installation that contains primarily CO, hydrogen, and hydrocarbon (usually methane) with the overall content of these three components in the second mixture being at least 50 volume %. In addition to CO, hydrogen, and hydrocarbon, these recovery gas mixtures ordinarily include heavy hydrocarbons (typically a few %), $CO_2$ (typically also a few %), and also traces of nitrogen and sulfur.

Although these industrial by-products may thus constitute an atmosphere acceptable for certain heat treatments such as cementation, they are too rich in combustible species to be used for protective applications. In such a case, to obtain the required inert atmosphere it is then necessary to reduce the content of CO, methane, and other higher hydrocarbons, which can be effectively accomplished using the process according to the invention.

In one embodiment of the invention, a heat exchange is carried out between the following two gaseous media:

- the heat treatment atmosphere exiting the catalytic reactor, between exit from this reactor and arrival of the atmosphere at the use location or at a storage location:
- the oxygen-containing first gas mixture, before its entry into the bottom of the catalytic reactor.

Such a heat exchange, for example, can be carried out in a plate exchanger-type gas/gas exchanger.

In the event of this implementation of heat exchange between the prepared atmosphere and the first gas mixture, it will be advantageous to circulate the hydrocarbon-containing second gas mixture in a conduit system which during part of its passage between the source of the second gas mixture and the reactor passes along an exterior wall of the exchanger, in order thereby to draw off part of the temperature from the exchanger (itself exterior) and preheat the second gas mixture (this "exterior" preheating must be carried out under moderate temperature conditions in order to avoid any risk of cracking the hydrocarbon before its entry into the reactor).

The invention also concerns an installation for preparing a heat treatment atmosphere comprising:

- a source of an oxygen-containing first gas mixture;
- a source of a hydrocarbon-containing second gas mixture;
- a catalytic reactor for gas deoxygenation;
- an inlet conduit system suitable for supplying the catalytic reactor with the first gas mixture and second gas mixture;
- an outlet conduit system suitable for removing from the catalytic reactor the heat treatment atmosphere resulting from the reaction in the reactor between the first gas mixture and the second gas mixture;
- which is characterized in that the catalytic reactor is incorporated into the installation in substantially vertical position, and in that the inlet conduit system is connected at its downstream end with the bottom of the reactor and the outlet conduit system is connected at its upstream end with the top of the reactor.

The source of the oxygen-containing first gas mixture can consist, for example, of a permeation-type or adsorption-type air separation plant, or of a mixture of air and cryogenically obtained nitrogen.

According to one aspect of the invention, the installation further comprises a gas/gas exchanger having at least a first path and a second path wherein the gas inlet for the first path is connected to the gas outlet of the catalytic reactor, the gas inlet for the second path is connected to the source of the first gas mixture, and the gas outlet from the second path is connected to the bottom of the catalytic reactor.

Other characteristics and advantages of the present invention will become apparent from the following description of modes of implementation, which is provided by way of illustration but is completely nonlimiting and which is written with reference to the drawings appended herewith, in which:

DETAILED DESCRIPTION OF PREFERRED EMBODIMENTS

Figure 1:
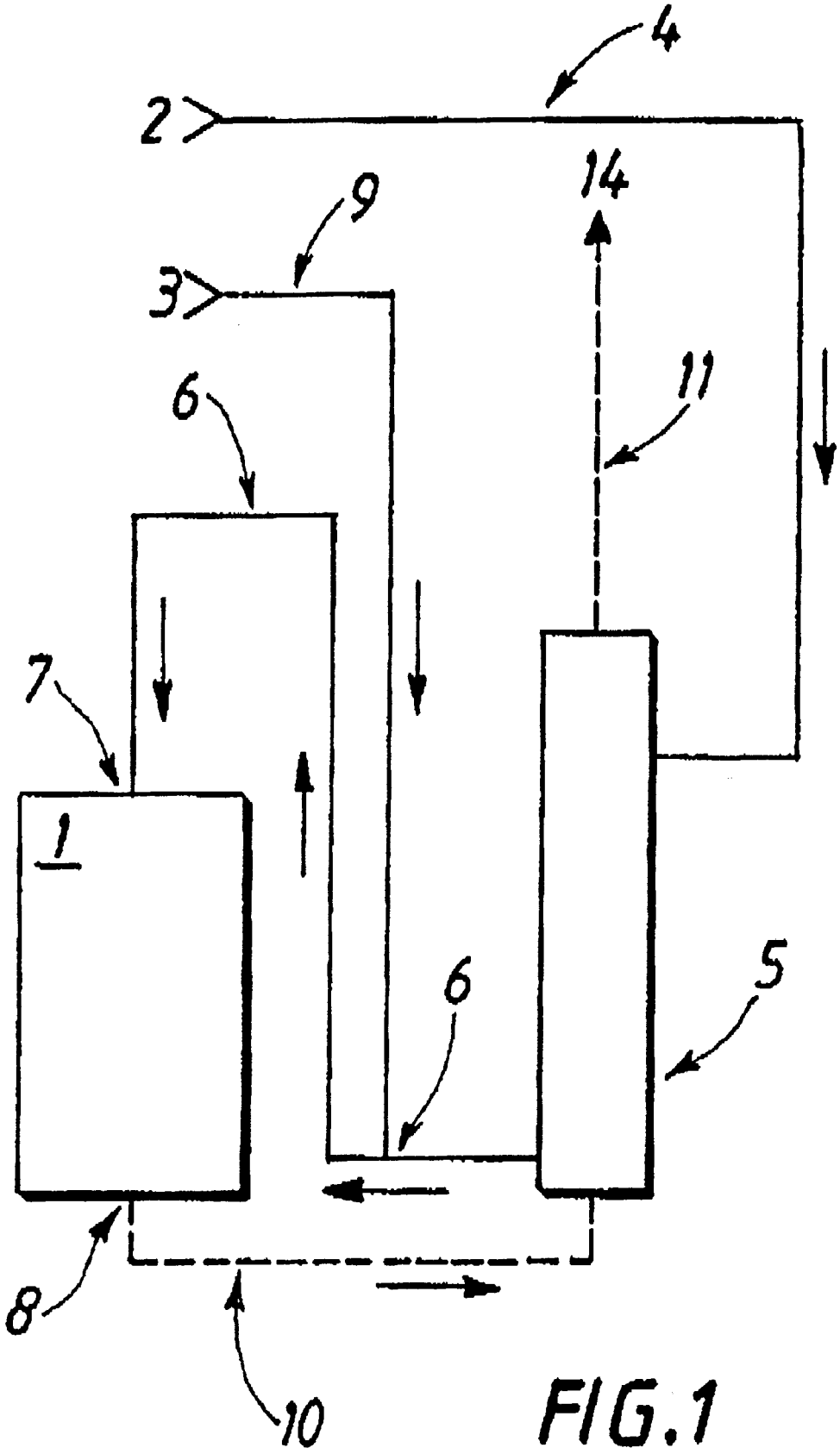
FIG. 1 is a schematic representation of an installation for the catalytic generation of a heat treatment atmosphere, which employs a catalytic reactor with entry of reaction gases through the top of the reactor.

In FIG. 1, the catalytic reactor 1 is supplied with gases from two sources:

a source 2 of the oxygen-containing first gas mixture (for example, an on-site permeation-type or adsorption-type nitrogen generator), and a source 3 of the hydrocarbon-containing gas mixture (for example, natural gas).

The first gas mixture is carried via line 4 to the inlet of one of the paths of a plate exchanger 5, from which it exits via line 6 and thereafter enters the upper inlet 7 of the catalytic reactor 1. The second gas mixture 3 is added to the first gas mixture via connecting line 9 before the first gas mixture arrives in the catalytic reactor.

The atmosphere resulting from the reaction between the two gas mixtures in the interior of the catalytic reactor is discharged, via the low point 8 of the catalytic reactor, through line 10 into another path in the exchanger 5, where it exchanges heat with the oxygen-containing first gas mixture 2.

After exchange in the exchanger 5, the heat treatment atmosphere is transferred through gas line 11 to the user 14.

Figure 2:
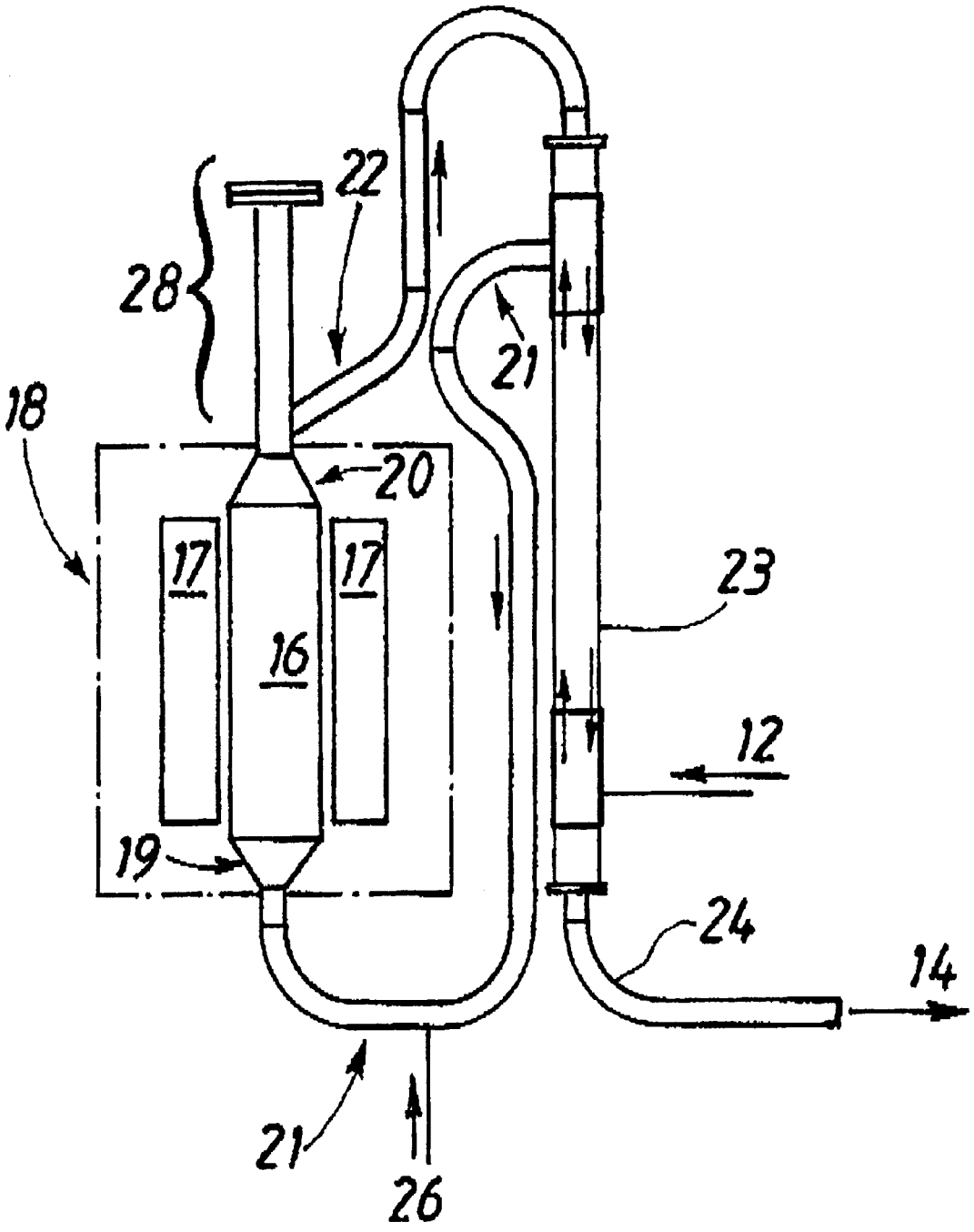
FIG. 2 is a schematic representation of an installation suitable for the implementation of the process according to the invention (entry of reaction gases through the bottom of the reactor)

In FIG. 2, which is a partial schematic illustration of an installation suitable for the implementation of the process according to the invention, the oxygen-containing gas mixture 12, after passing through one path of a plate exchanger 23, is transferred through a conduit system 21 to the low point 19 of a catalytic reactor 16. The hydrocarbon-containing second gas mixture 26 is added to this first gas mixture before the first gas mixture has arrived at the catalytic reactor.

The heat treatment atmosphere resulting from the reaction between the two mixtures in the interior of the reactor 16 is discharged at the high point 20 of the catalytic reactor through a gas line 22 into another path of the exchanger 23—from which it exits through a conduit 24 to be transferred to the user 14.

Reference number 17 denotes the heating resistances surrounding the catalytic reactor, and the reference number 18 denotes a thermal insulation surrounding the reactor.

The number 28 denotes an advantageous arrangement of the upper part which enables this reactor to be supplied with catalyst, and which will be detailed below in the context of FIGS. 3 and 4.

Considering the temperatures employed in the catalytic reactor (several hundred ° C.), and in order to maintain a perfect tightness in this part of the installation, it is advantageous to avoid the presence of gaskets and flanges between the various elements that make up the catalytic reactor and between the reactor and the fittings that are to be connected to the reactor. The applicant has been able in effect to establish that such gaskets and flanges at this level of the installation inevitably experience mechanical stress and strain, leading to substantial losses in tightness, which necessarily represents some safety risk considering the typical composition of the atmospheres passing through the reactor (presence of hydrogen, CO, hydrocarbon, etc.).

In this context, it is very advantageous to use welding to join the various elements of the reactor to one another and to the fittings that attach to the reactor. However, the use of welds (i.e., their "permanent" character) then poses problems in terms of the ability to easily carry out replacement of catalyst and supply the reactor with fresh catalyst.

Figure 3:
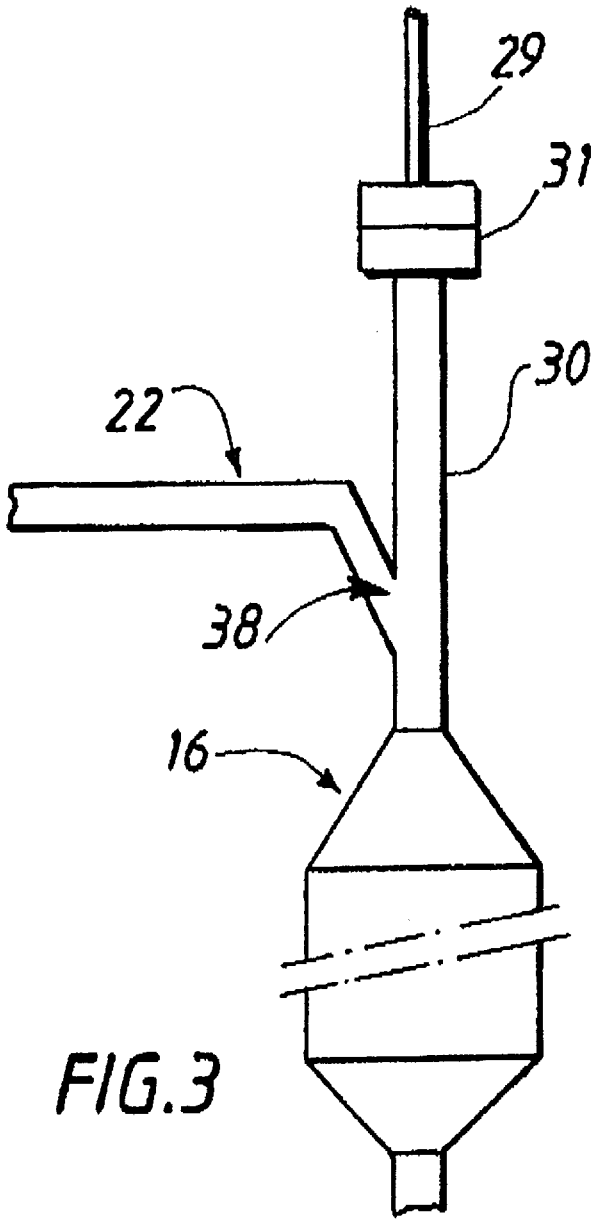
FIG. 3 is a partial schematic representation illustrating one embodiment of the top part of the catalytic reactor.
Figure 4:
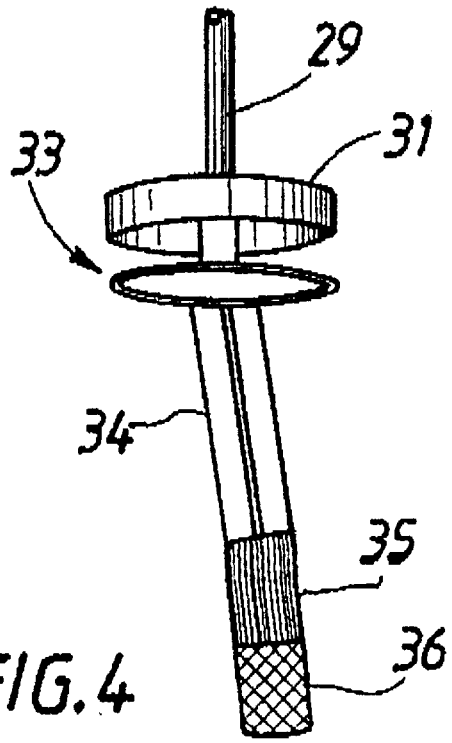
FIG. 4 is a detail view of the flange for closure and for supplying catalyst to the catalytic reactor of FIG. 3.

FIGS. 3 and 4 specifically illustrate a very particularly advantageous configuration of the upper part of the reactor which permits the reactor to be supplied with fresh catalyst under favorable conditions in terms of both safety and ease of handling. FIG. 3 shows the upper conical part of the reactor 16, to which there is attached an outlet conduit 30 having a branch 22 which permits discharge of the heat treatment atmosphere resulting from the reaction carried out in the interior of the catalytic reactor.

All the points of attachment between the various elements of the reactor and between the reactor and the gas conduits connected to the reactor are advantageously executed by welds. It is then possible, with the flange 31 and the conduit 30, to aspirate spent catalyst in order to reintroduce fresh catalyst. FIG. 4 serves to better illustrate the structure of stem 29, which is solidly attached to the upper part of the flange 31 and located in the interior of the conduit 30, and which makes it possible to open this part of the installation to some extent: the stem 29 is solidly attached to the upper part of the flange 31, as well as to the gasket 33, and, when drawn upward, draws with it in succession an insulator 34, a section of refractory brick 35, and a mesh screen 36 whose function will be detailed below.

Because the flange 31 is relatively remote from the discharge path of the gases, the temperature to which it is subjected is relatively low (generally close to 100° C.). It thus experiences relatively little stress and strain and is therefore compatible with the goal of obtaining a good tightness.

The structure of the insulator 34 and section of refractory brick 35 solidly attached thereto functions to improve their insulation performance even further, ensuring a low temperature for the flange and gasket.

It is then easy with this system to aspirate the spent catalyst from and add fresh catalyst to the reactor while maintaining an excellent tightness performance for the entire reactor.

When the system 28 is in place, the mesh screen 36 resides in the interior of the conduit 30 opposite the point 38 where the branch 22 is connected to this conduit 30. This mesh screen 36 functions to intercept in flight particles of catalyst which could potentially be entrained with the atmosphere prepared in the reactor in its ascent from the bottom to the top of the reactor and its discharge through the conduit 22.

As will be clearly apparent to the individual skilled in the art, while the preceding description of the assembly 28 has been given in terms of an "outlet conduit system 22 which attaches to the conduit 30", it could also clearly be implemented—without departing from the scope of the invention—in terms of a "conduit 30 which attaches to the outlet conduit system 22"; the key point actually resides, beyond simply the terms involved, in the fact that the flange system is located in a position relatively remote from the hot spots and thus experiences relatively little mechanical stress and strain.

Likewise, while these figures illustrate very particularly the case where the conduit 30 is equipped with a flange system to permit facile aspiration of the spent catalyst and supply of fresh catalyst, it is also possible, without departing from the scope of the present invention, more generally to use any other system which permits opening and closing of the conduit 30, such as a bolt or a plug.

Figure 5:
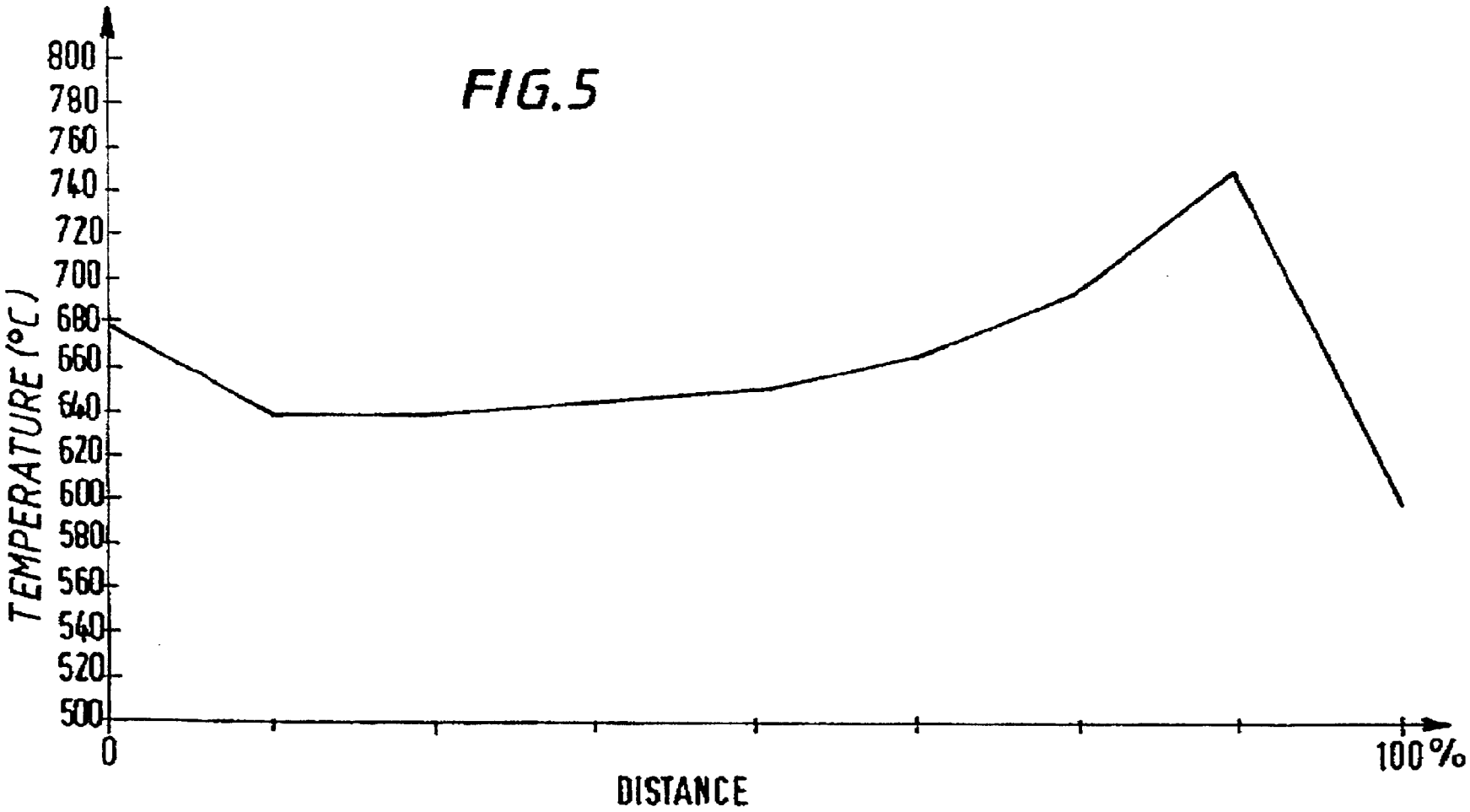
FIG. 5 is an example of the thermal profile obtained in the catalytic reactor for the case of injection of the reaction gases through the top of the catalytic reactor.
Figure 6:
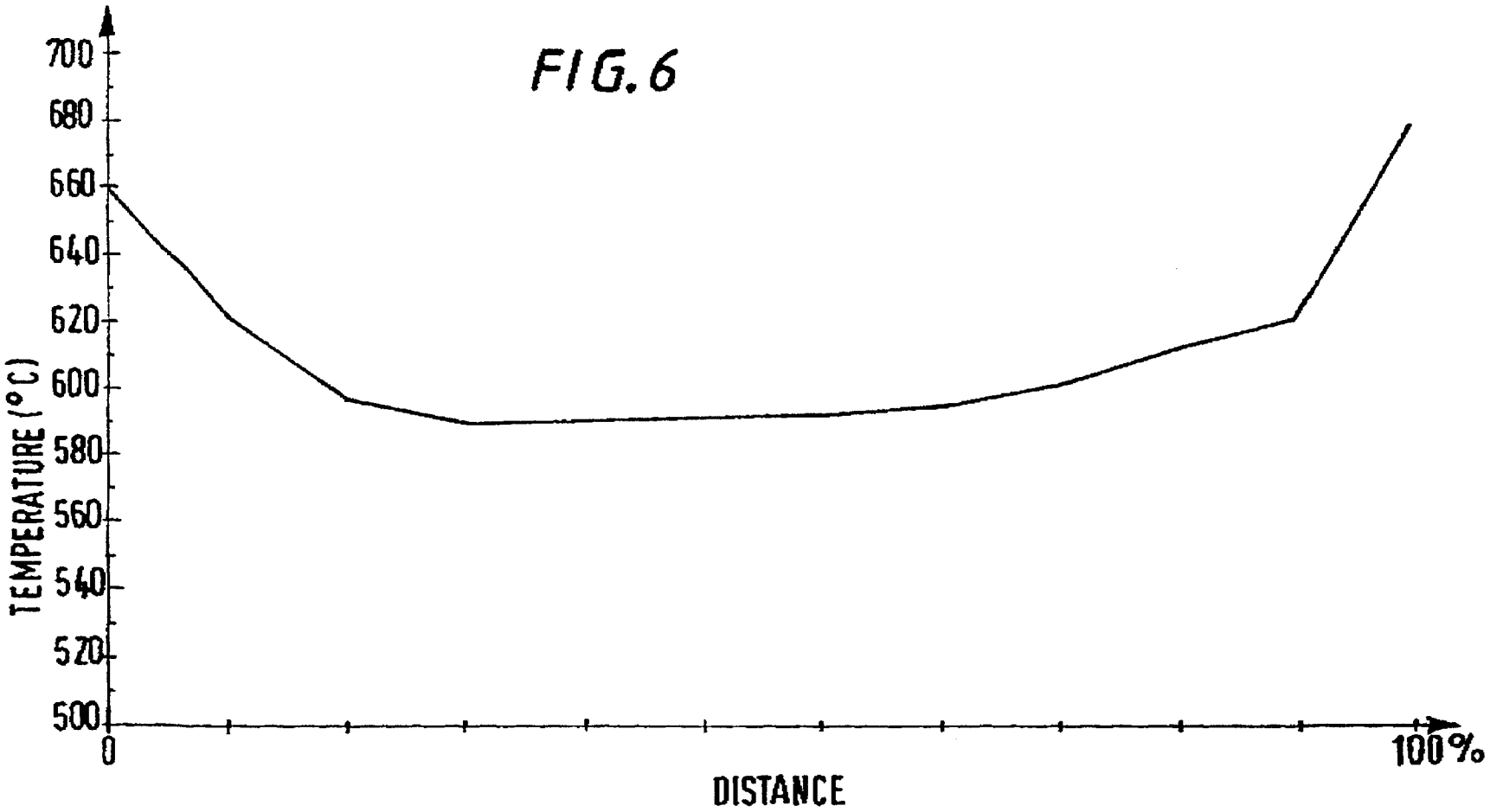
FIG. 6 is an example of the thermal profile obtained in the interior of the catalytic reactor for the case of injection of reaction gases according to the invention (through the bottom of the reactor).

FIGS. 5 and 6 illustrate the comparative results obtained for thermal profiles measured within the catalyst cartridge according to whether the reaction gases were injected through the top of the reactor (FIG. 5) or through the bottom of the reactor (FIG. 6).

Represented on the abscissa is the distance in the interior of the catalyst cartridge, with the end of the abscissa scale ("100%") representing the end of the cartridge.

The curves were obtained under the following conditions:

the temperature setpoint given to the exterior resistances 17 was approximately 950° C.;

the oxygen-containing first gas mixture was an impure nitrogen containing 3% residual oxygen yielded by permeation-based air separation, while the hydrocarbon-containing second gas mixture was methane, present in the overall mixture at a level of 6 volume %;

the overall output of atmosphere thus prepared was approximately 50 $Nm^3/h$;

the point 0 on the distance scale on the abscissa in both cases represents the low point of the catalyst cartridge.

An examination of these two thermal profiles supports the following remarks:

it is clearly seen that when the mode of injection is through the top a temperature peak, with a height of nearly 100° C., occurs in the top section of the catalyst. These observations serve to corroborate the considerations set forth above regarding the direction of gas circulation by natural convection, as well as the location of the endothermic reactions in the catalyst cartridge in this case.

on average, for an equal setpoint level of applied heat, the catalyst temperature recorded along the length of the cartridge is, in the case of injection through the bottom, lower by approximately fifty ° C.

The composition of the heat treatment atmosphere obtained in the case of injection through the bottom was as follows:

$N_2$=84.4%

CO=5%

$H_2$=10%

$CH_4$=0.4%

$CO_2$=0.1%

$H_2O$=dew point=−25° C.

$O_2$:<10 ppm

In comparison, the heat treatment atmosphere resulting from these operating conditions for injection of the reaction gases through the top is characterized by a residual $CO_2$ concentration on the order of 0.2% and a dew point in the vicinity of −20° C., thus giving clearly poorer conditions in terms of oxidizing species.

Furthermore, it will be observed that the injection of reaction gases through the bottom of the reactor, besides helping to keep the endothermic reactions in the most thermally favorable section of the reactor, also seems to limit to some degree the occurrence of compaction of the catalyst pellets (probably by imparting to them a degree of motion), which in turn to some degree limits the pressure increase in the reactor. Because higher pressures thermodynamically favor the exothermic reactions in this reaction system, this control of the pressure by injection from the bottom therefore also serves to favor the endothermic reactions for production of hydrogen and CO.

We claim:

1. Installation for preparing a heat treatment atmosphere, comprising:

a source of an oxygen-containing first gas mixture;

a source of a hydrocarbon-containing second gas mixture;

a catalytic reactor for gas deoxygenation incorporated into the installation in a substantially vertical position and including an interior portion, a bottom portion and a top portion, the reactor comprising parts connected therebetween by welding without gaskets or other connecting flanges;

an inlet conduit system suitable for supplying the catalytic reactor with a mixture of the first gas mixture and the second gas mixture, the inlet conduit system being connected, at a downstream part, with the bottom portion of the reactor; and an outlet conduit system connected to remove from the top portion of the catalytic reactor a heat treatment atmosphere resulting from a reaction in the reactor between said first gas mixture and said second gas mixture; and a conduit connected at one end to said outlet conduit system and which is equipped at its other end with a system that permits opening and closing of the conduit at a remote location from said catalytic reactor, in order to permit removal through said system of spent catalyst from the reactor and/or introduction of fresh catalyst through said system into the interior of the reactor.

2. Installation according to claim 1, further comprising a catalyst replacement system that permits removal of spent catalyst from the reactor and/or introduction of fresh catalyst into the interior of the reactor.

3. Installation according to claim 2, wherein said catalyst replacement system comprises a flange adapted to be connected to the outlet conduit system and being removable therefrom.

4. Installation according to claim 3, said catalyst replacement system further comprising a gasket interposed between said flange and the outlet conduit system when said flange is connected to the outlet conduit system.

5. Installation according to claim 3, said catalyst replacement system further comprising an insulator on one side of the flange, said insulator extending into the outlet conduit system when the flange is connected thereto, and being removable from the outlet conduit system with the flange.

6. Installation according to claim 5, said catalyst replacement system further comprising a refractory brick on said one side of the flange for improving the insulation performance, said refractory brick being removable from the outlet conduit system with the flange.

7. Installation according to claim 6, said catalyst replacement system further comprising a mesh screen on said one side of the flange for intercepting any catalyst particles entrained with the atmosphere, said mesh screen being removable from the outlet conduit system with the flange.

8. Installation according to claim 7, said catalyst replacement system further comprising a stem connected to said flange for removing said flange, said insulator, said refractory brick and mesh screen from said outlet conduit system.

9. Installation according to claim 3, said catalyst replacement system further comprising a stem connected to said flange for removing said flange from said outlet conduit system.

10. Installation according to claim 1, wherein the source of the first gas mixture is an air separator operated by permeation or adsorption, suitable for producing nitrogen having a residual oxygen concentration between 0.5% and 7%.

11. Installation according to claim 1, wherein the source of the first gas mixture is a mixture of air and cryogenic nitrogen.

12. Installation according to claim 1, wherein the source of the second gas mixture is an industrial site producing a gaseous by-product containing nitrogen, hydrogen, carbon monoxide, and a hydrocarbon, wherein total content of hydrogen, carbon monoxide, and the hydrocarbon in the mixture is equal to at least 50%.

13. Installation according to claim 1, further comprising a gas/gas exchanger having at least two paths, wherein the first path is suitable for conveying the heat treatment atmosphere prepared in the catalytic reactor and the second path is suitable for conveying said first gas mixture prior to its entry into the catalytic reactor.

14. Installation according to claim 1, wherein said inlet and outlet conduit systems are connected to the reactor by welding, without gaskets or other connecting flanges.

15. Installation for preparing a heat treatment atmosphere, comprising:

a source of an oxygen-containing first gas mixture;

a source of a hydrocarbon-containing second gas mixture;

a catalytic reactor for gas deoxygenation incorporated into the installation in a substantially vertical position and including an interior portion, a bottom portion and a top portion;

an inlet conduit system suitable for supplying the catalytic reactor with a mixture of the first gas mixture and the second gas mixture, the inlet conduit system being fixedly connected by welding, without gaskets or connecting flanges, at a downstream part, to the bottom portion of the reactor; and an outlet conduit system fixedly connected by welding, without gaskets or connecting flanges to the top portion of said reactor in order to remove a heat treatment atmosphere resulting from a reaction in the reactor between said first gas mixture and said second gas mixture; and a conduit connected at one end to said outlet conduit system and which is equipped at its other end with a system that permits opening and closing of the conduit at a remote location from said catalytic reactor, in order to permit removal through said system of spent catalyst from the reactor and/or introduction of fresh catalyst through said system into the interior of the reactor.

* * * * *